US012612790B2

(12) United States Patent
Hurst

(10) Patent No.: US 12,612,790 B2
(45) Date of Patent: Apr. 28, 2026

(54) HIDDEN FASTENER FOR ABUTTING BOARDS

(71) Applicant: TREX COMPANY, INC., Winchester, VA (US)

(72) Inventor: Jacob Hurst, Winchester, VA (US)

(73) Assignee: Trex Company, Inc., Winchester, VA (US)

( * ) Notice: Subject to any disclaimer, the term of this patent is extended or adjusted under 35 U.S.C. 154(b) by 202 days.

(21) Appl. No.: 18/451,435

(22) Filed: Aug. 17, 2023

(65) Prior Publication Data

US 2024/0060316 A1 Feb. 22, 2024

Related U.S. Application Data

(60) Provisional application No. 63/371,648, filed on Aug. 17, 2022.

(51) Int. Cl.
*E04F 15/02* (2006.01)

(52) U.S. Cl.
CPC ..... *E04F 15/02044* (2013.01); *E04F 2015/02122* (2013.01); *E04F 15/02183* (2013.01)

(58) Field of Classification Search
CPC ..... E04F 15/02044; E04F 2015/02122; E04F 15/02183; E04F 2015/02094
See application file for complete search history.

(56) References Cited

U.S. PATENT DOCUMENTS

| | | | | |
|---|---|---|---|---|
| 4,925,141 | A * | 5/1990 | Classen | E04B 5/12 248/300 |
| 5,394,667 | A | 3/1995 | Nystrom | |
| 5,617,689 | A | 4/1997 | Beane | |
| 5,623,803 | A | 4/1997 | Willis | |
| 5,775,048 | A | 7/1998 | Orchard | |
| 5,850,720 | A | 12/1998 | Willis | |
| 6,112,479 | A | 9/2000 | Andres | |
| 6,233,886 | B1 | 5/2001 | Andres | |
| 6,301,842 | B1 | 10/2001 | Chaney et al. | |
| 6,402,415 | B1 * | 6/2002 | Eberle, III | E04F 15/04 403/231 |
| 6,550,206 | B2 | 4/2003 | Lee | |
| 6,564,522 | B1 | 5/2003 | Chiu-Ying | |
| 6,594,961 | B2 | 7/2003 | Leines | |
| 6,694,681 | B1 | 2/2004 | Andres | |
| 7,516,586 | B2 | 4/2009 | Riccitelli | |

(Continued)

FOREIGN PATENT DOCUMENTS

| | | | |
|---|---|---|---|
| DE | 202011106654 U1 * | 4/2012 | E04F 15/04 |
| EP | 1691002 A2 | 8/2006 | |

(Continued)

*Primary Examiner* — Theodore V Adamos
(74) *Attorney, Agent, or Firm* — The Belles Group, P.C.

(57) ABSTRACT

In an exemplary embodiment, a hidden fastener may include a constraining member configured to support a plurality of boards, and a base member extending below the constraining member. The base member includes a pair of leg portions, each leg portion includes an opening at an inclined angle for receiving a fastener at an inclined position. The pair of leg portions is attached to a structural member via a spacing formed between the pair of leg portions, the spacing corresponding to a size of a top surface of a structural element.

20 Claims, 10 Drawing Sheets

(56) References Cited

U.S. PATENT DOCUMENTS

| | | | | |
|---|---|---|---|---|
| 7,874,113 | B2 * | 1/2011 | Eberle, III | E04F 15/04 |
| 8,534,526 | B2 | 9/2013 | Orchard | |
| 8,544,229 | B2 | 10/2013 | Kilgore et al. | |
| 8,910,442 | B2 | 12/2014 | Lachevrotiere et al. | |
| 8,973,326 | B2 | 3/2015 | Lenoci | |
| 9,309,677 | B1 | 4/2016 | Anic | |
| 9,416,546 | B2 | 8/2016 | Claudin | |
| 9,458,635 | B1 | 10/2016 | Anic | |
| 9,518,395 | B2 | 12/2016 | Kuijper | |
| 9,593,490 | B2 | 3/2017 | Anic | |
| 9,650,789 | B2 | 5/2017 | Gulnick | |
| 9,695,597 | B2 | 7/2017 | Wagner | |
| 9,890,543 | B2 | 2/2018 | Aquilani | |
| 9,976,311 | B2 | 5/2018 | Gulnick | |
| 10,041,258 | B2 | 8/2018 | Pervan | |
| 10,119,273 | B2 | 11/2018 | Andres et al. | |
| 10,487,460 | B2 | 11/2019 | Lee | |
| 10,494,820 | B1 * | 12/2019 | Chen | E04F 15/02038 |
| 10,577,807 | B2 | 3/2020 | Doupe et al. | |
| 10,895,080 | B1 * | 1/2021 | MacKenzie | E04F 15/02044 |
| 11,098,489 | B1 | 8/2021 | Wheatley, III | |
| 11,149,445 | B2 | 10/2021 | Vandenberg et al. | |
| 2004/0020153 | A1 | 2/2004 | Huang | |
| 2008/0222993 | A1 | 9/2008 | Prichard et al. | |
| 2009/0094925 | A1 | 4/2009 | Andres et al. | |
| 2012/0227348 | A1 | 9/2012 | Turner | |
| 2014/0366334 | A1 * | 12/2014 | Gamble | F16B 2/14 24/305 |
| 2015/0059271 | A1 | 3/2015 | Tsai | |
| 2016/0168867 | A1 | 6/2016 | Chester | |
| 2016/0362902 | A1 | 12/2016 | Lee et al. | |
| 2017/0130465 | A1 | 5/2017 | Claudin | |
| 2018/0127986 | A1 | 5/2018 | Claudin | |
| 2018/0179764 | A1 | 6/2018 | Pervan | |
| 2018/0238060 | A1 | 8/2018 | Doupe et al. | |
| 2019/0284796 | A1 * | 9/2019 | Bowker | E04B 1/388 |

FOREIGN PATENT DOCUMENTS

| | | | | |
|---|---|---|---|---|
| EP | 1771630 | B1 | 8/2009 | |
| EP | 2278092 | A2 | 1/2011 | |
| EP | 2369094 | A1 | 9/2011 | |
| EP | 1945881 | B1 | 12/2014 | |
| EP | 2977525 | A1 | 1/2016 | |
| EP | 3090850 | A1 * | 11/2016 | B27M 3/04 |
| EP | 2878743 | B1 | 8/2017 | |
| EP | 3140471 | B1 | 12/2018 | |
| EP | 3060728 | B1 | 4/2019 | |
| EP | 3527742 | A1 | 8/2019 | |
| EP | 3527743 | A1 | 8/2019 | |
| EP | 2382361 | B1 | 11/2019 | |
| EP | 3119960 | B1 | 5/2020 | |
| EP | 3660241 | B1 | 1/2022 | |
| KR | 200451912 | Y1 * | 1/2011 | |
| KR | 20190034750 | A * | 4/2019 | |
| KR | 102180567 | B1 * | 11/2020 | |
| KR | 20210022595 | A * | 3/2021 | |
| WO | WO-2017130107 | A1 * | 8/2017 | E04F 15/02044 |
| WO | 2019030656 | A1 | 2/2019 | |
| WO | 2019160233 | A1 | 8/2019 | |
| WO | 2019217994 | A1 | 11/2019 | |

* cited by examiner

HIDDEN FASTENER FOR ABUTTING BOARDS

CROSS REFERENCE TO RELATED APPLICATION

This application claims benefit of U.S. Provisional Application No. 63/371,648, filed Aug. 17, 2022 and entitled "Butt Joint Clip", the entire disclosure of which incorporated by reference herein.

TECHNICAL FIELD

The present disclosure relates to a fastening system for decking boards/floor boards. More specifically, the present disclosure is directed to a fastening system for installing butt joints of decking boards/floor boards.

BACKGROUND

Outdoor structures, such as decks, are popular as living spaces that extend beyond the interior of the home. Typically, individual boards are used to create a horizontal walking surface using fasteners, such as nails or screws to fasten the boards to a structural member (e.g., joists, headers, posts) or to an adjacent board. However, these fasteners provide several shortcomings, such as structural integrity, difficulty and discomfort of use, and various aesthetic limitations. For example, nails or screws can be employed on a (top) surface of the board to fasten the boards to the structural member. One particular area for installing the boards to the structural member is at ends of the boards, i.e., butt joints. That is, butting ends of two adjacent deck boards on the structural member. However, having the fasteners so close to the ends of the board tends to weaken the boards as harsh environmental factors such as moisture and UV exposure degrades (i.e., rusting) the fasteners, thus causing the boards to crack or split and compromise the structural integrity and aesthetic appearance of the decking assembly. This in turn weakens the fastening function of the nails and screws causing the board(s) to detach from the structural member. Additionally, the rusting effect may cause discoloration to a portion (i.e., top surface) of the boards and produce an unattractive, worn appearance to the deck.

As an alternative to nails and screws, hidden fasteners (e.g., connector clips) have been used for deck assembling and are gaining popularity among builders and homeowners. These hidden fasteners produce a more finished appearance, as no visible nails or screws (or screw holes) are visible after installation. Such hidden fasteners typically anchor a board to the substructure, coupling the boards to each other and to the frame below, i.e., joist. This in turn hides the nails and screws from view and reduces cracking or splitting of the boards, which also poses the risk of possible cuts or splinters to users. However, when using hidden fasteners for butt joints, some installers use a conventional single hidden fastener in an attempt to join the two adjacent ends of the boards. In one implementation, the conventional single hidden fastener is attached at the sides of each board near the ends thereof. However, due to expansion and contraction of the board caused by the environment, the conventional single hidden fastener cannot contain enough of a force to hold the boards together and/or against the joist. This causes the boards to release from the hidden fastener. Further, while fastener uplift strength is a consideration, it is also an inadequate overlapping surface area when using a single fastener that can cause the boards to become unconstrained, since they can translate over many thermal cycles until the fastener geometry no longer intersects with the geometry of the board in an effective way (or at all).

Other approaches such as installing a sister joist have been used, which employs attaching another joist to an existing joist or installing it alongside an existing joist for abutting the ends of the boards. As such, hidden fasteners are installed on each joist at the end of each abutting board, requiring at least four (4) hidden fasteners at any single abutment in a typical installation. Moreover, requiring four hidden fasteners necessitates using additional fasteners (i.e., screws) to attach the four hidden fasteners to the respective joist, which increases material costs and the additional labor to install these parts. Additionally, in this approach, the hidden fasteners are installed on a topside of the joist; however, this causes the single top-driven fasteners to pull out due to softness (caused by age or moisture content) on the topside of the joists, leading to unconstrained boards.

In view of the problems associated with these alternative approaches for deck assembly, there remains a need to provide a fastener system for installing butt joints adequately and efficiently.

SUMMARY

In an exemplary embodiment, a hidden fastener includes a constraining member configured to constrain a plurality of boards, and a base member extending below the constraining member. The base member includes a pair of leg portions having an inclined opening at each leg portion for receiving a fastener at an inclined position. The pair of leg portions is attached to a structural member via a spacing formed between the pair of leg portions. The spacing corresponds to a size of a top surface of a structural element.

In another exemplary embodiment, a method of installing a hidden fastener to a butt end of a board includes attaching a first hidden fastener to a structural member, the first hidden fastener includes a pair of leg portions that correspondingly engages to a top surface of the structural member, engaging a first side of a first board to the first hidden fastener, engaging a first side of a second board to the first hidden fastener, attaching a second hidden fastener to the structural member opposite to the first hidden fastener, the second hidden fastener includes a pair of leg portions that correspondingly engages to the top surface of the structural member, engaging a second side of the first board to the second hidden fastener, and engaging a second side of the second board to the second hidden fastener.

Other features and advantages of the present invention will be apparent from the following more detailed description of the preferred embodiment which illustrates, by way of example, the principles of the invention.

Figure 1:
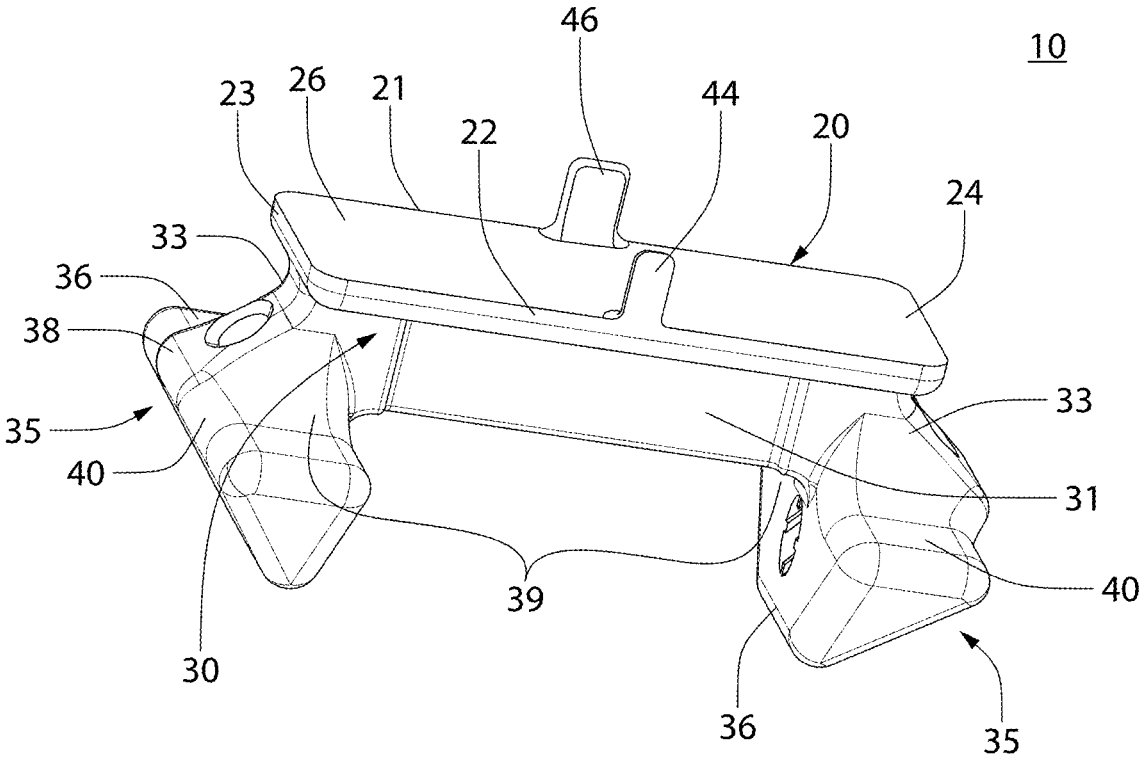
FIG. 1 is a perspective view of a hidden fastener according to an example embodiment of the present disclosure.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. For example, the relative thicknesses and positioning of layers, regions and/or structural elements may be reduced or exaggerated for clarity. The use of similar or identical reference numbers in the various drawings is intended to indicate the presence of a similar or identical element or feature.

DETAILED DESCRIPTION

A hidden fastener (e.g., a connector clip) according to the present disclosure is a device for use in conjunction with (deck)boards to abut at least the ends of the boards atop a structural member (e.g., joist). In a conventional approach, a sister joist is generally required next to an existing joist for installing butt joints. However, besides the cost of material for the additional joist, installing sister joists is time consuming and labor intensive requiring installers to possibly work underneath the deck and handle heavy structural members causing possible injuries. Therefore, the hidden fastener disclosed herein requires fewer parts and is easier to install. That is, only two hidden fasteners will be required instead of the conventional four hidden fasteners, fewer fasteners (e.g., screws) to install to the structural member, and no sister joist will be required.

As described herein, the term "connector clip" is interchangeable with and/or described as a "hidden fastener" that is configured to fasten adjacent to or under the ends of the boards, which in effect hides the connector clip from plain sight while constraining the movement of (adjacent) boards. The term "fastener assembly" described herein includes the connector clip (or hidden fastener) and a fastener (e.g., screw) assembled together prior to or during installation.

For simplicity, the hidden fastener will be described in simplified fashion with relation to a deck system. It should be noted that the figures exemplify various aspects of the hidden fastener in use but do not illustrate a complete deck system. It should also be noted that the hidden fastener is useful in other environments and using other combinations and assembly sequences and all such uses are part of this invention. It will further be appreciated that in some of the drawings, some boards and/or joists are shown as transparent in order to better illustrate certain features of operation.

FIGS. 1 to 4 illustrate one example embodiment of a hidden fastener 10 used to join ends of a deck board 50 to a structural member 15 (e.g., a joist). The hidden fastener 10 includes a deck board constraining member 20 for supporting a plurality of deck boards 50 and a base 30 that extends below the constraining member 20. The constraining member 20 is generally rectangular in shape and has a first side 21, a second side 22 opposite the first side 21, a third side 23, and a fourth side 24 opposite the third side 23. In one implementation, the first and second sides 21, 22 correspond to long sides and the third and fourth sides 23, 24 correspond to short sides. The constraining member 20 also includes a top surface 26 where a portion of the board 50 is supported and/or constrained.

Figure 2:
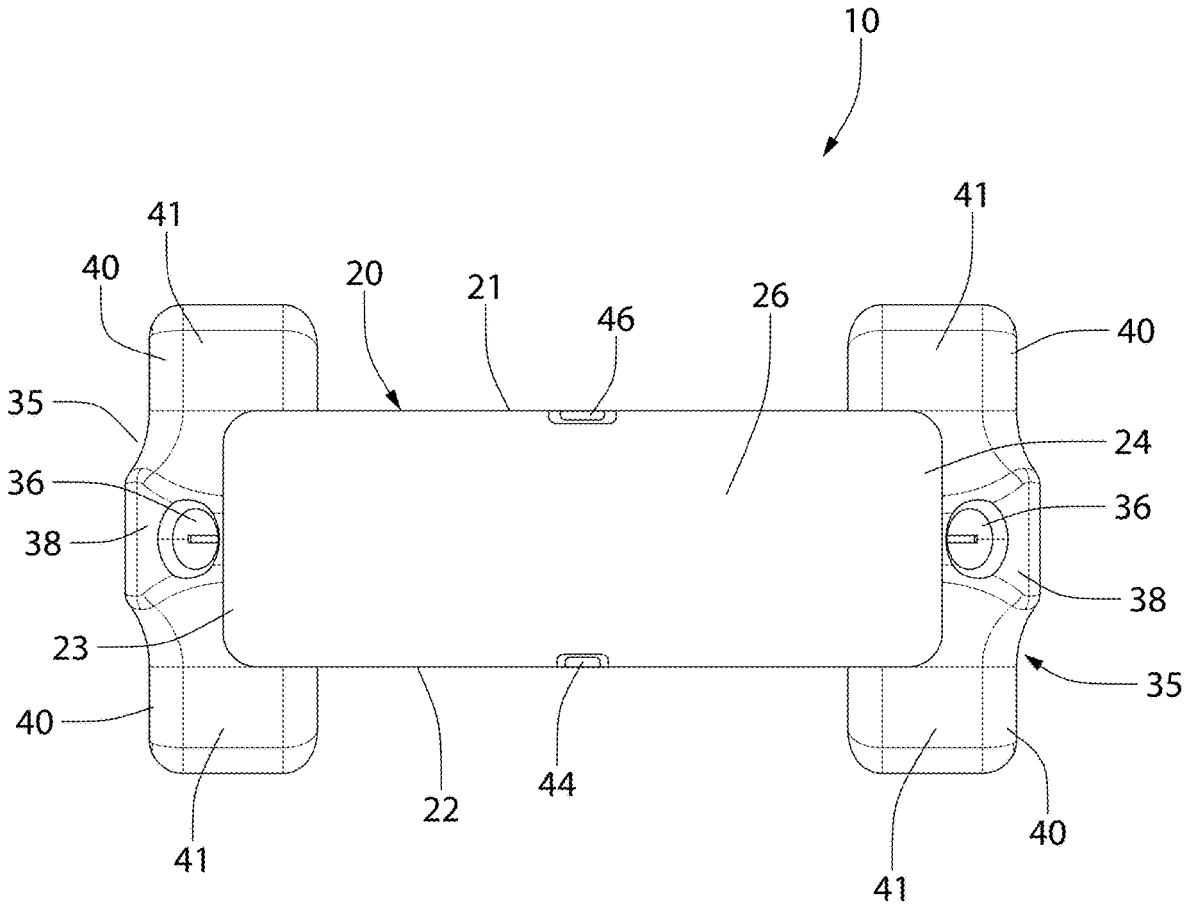
FIG. 2 is a plan view of the hidden fastener of FIG. 1.
Figure 3:
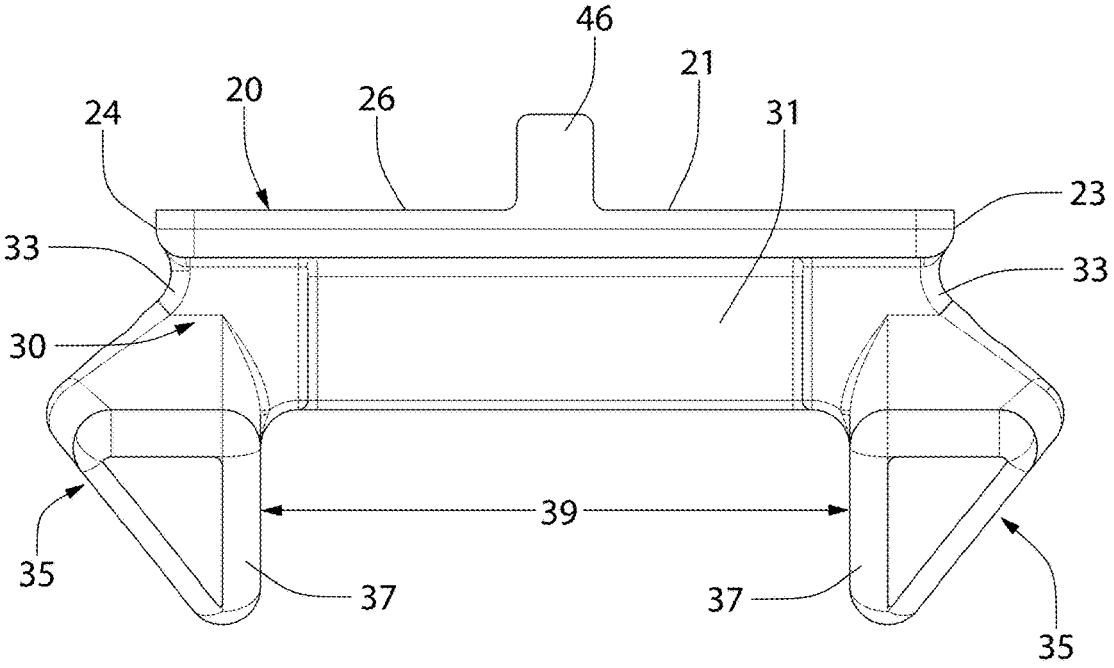
FIG. 3 is a front view of the hidden fastener of FIG. 1.
Figure 4:
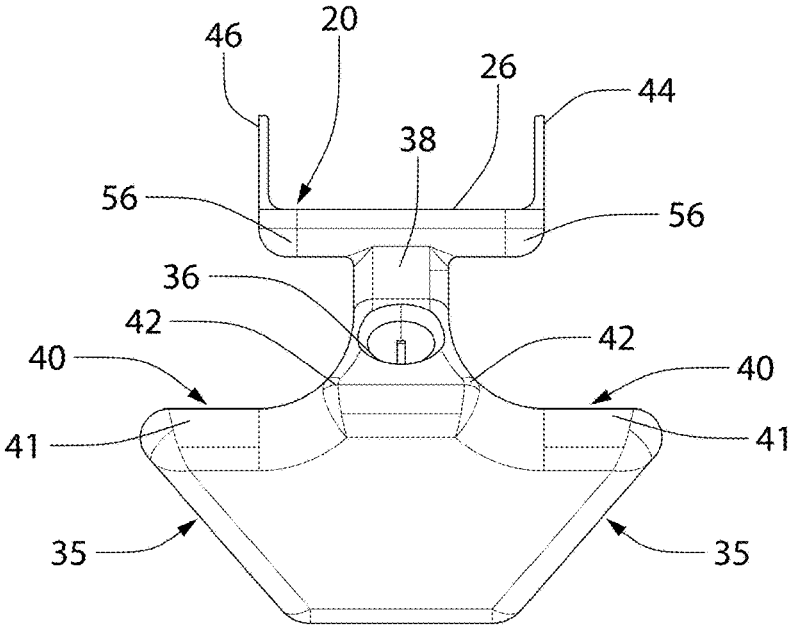
FIG. 4 is a side view of the hidden fastener of FIG. 1.
Figure 6:
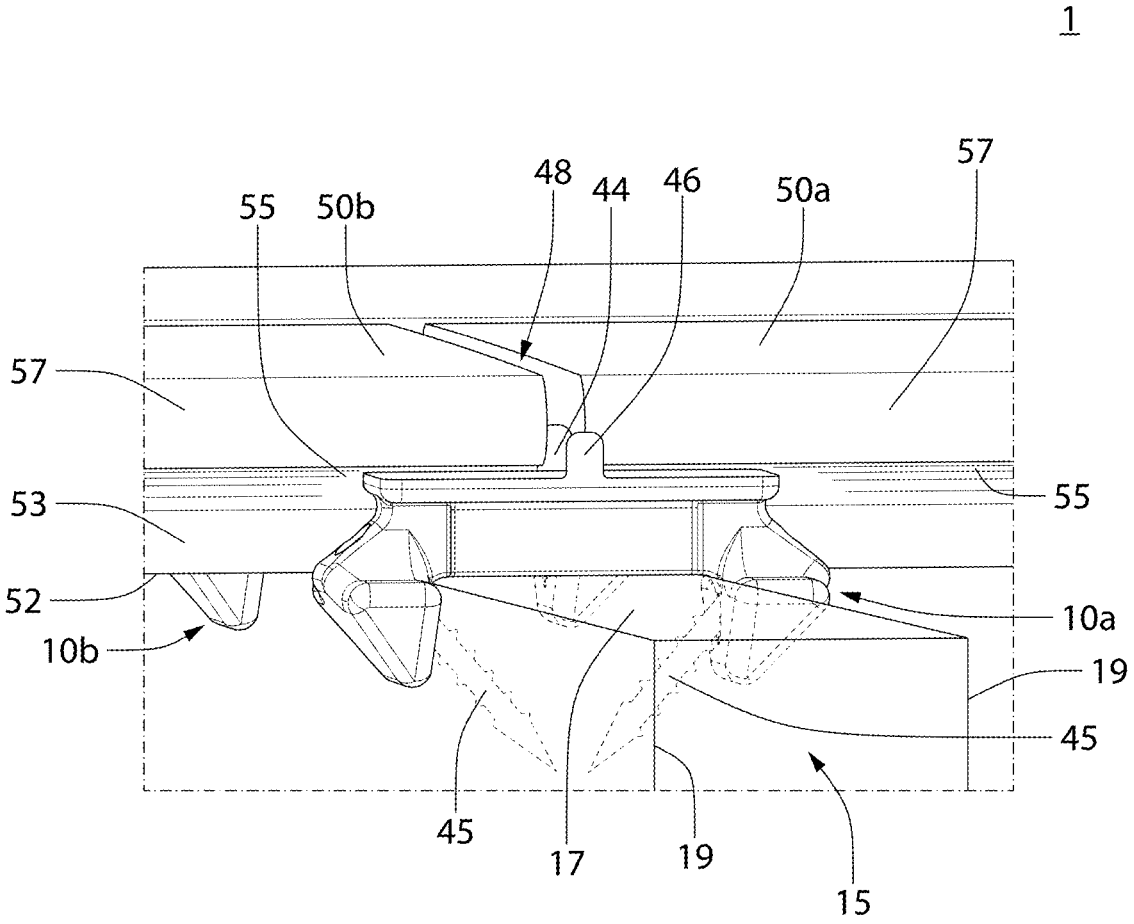
FIGS. 6-11 are perspective views of the hidden fastener of FIG. 1 in use in a decking system, according to an example embodiment of the present disclosure.

The base 30 includes a base portion 31 that extends below the constraining member 20. The base portion 31 can be integrally formed with the constraining member 20, or alternatively, formed separately from the constraining member 20 using conventional methods. The base portion 31 is substantially rectangular in shape having a similar shape as the constraining member 20. However, the base portion 31 is smaller in size in relation to the constraining member 20. In other words, the base portion 31 is formed smaller than the constraining member 20 such that extending members 56 (at sides 21, 22), as shown in FIG. 4, are formed which are designed to engage with the boards 50. To describe in a different manner, the extending members 56 project out over the base portion 31. Extending at each end side 33 of the base 30 includes a leg portion 35 that projects generally perpendicular in relation to the base portion 31, as shown in FIGS. 2 and 3. The leg portions 35 correspondingly engage the structural member, i.e., joist 15 to firmly support the entire base 30 against the joist 15. Further, due to the extended design of a pair of leg portions 35, an opening or space 39 is formed between the leg portions 35 to engage with the joist 15. That is, the space 39 matches a dimension of a top surface 17 of the joist 15 to securely attach the hidden fastener 10 against a single joist 15, as shown in FIG. 6. In one implementation, a typical width dimension of a single joist is approximately 1.5-2.0 inches, and hence, the space 39 separating the pair of leg portions 35 should correspondingly be approximately 1.5-2.0 inches. Further, each leg portion 35 includes an inner planar surface 37 (shown in FIG. 3) that is configured to engage (i.e., contact) a planar side surface 19 of the joist 15 forming the same shape and size as the joist 15, i.e., a generally rectangular shape. It should be appreciated that a distance between the two inner planar surface 37 corresponds to the distance of the space 39. Unlike conventional hidden fasteners, a sister joist is not required or installed as the present hidden fastener 10 is directly installed to a single joist for butt jointing two adjacent boards 50. As a result, this provides cost savings in materials and saves considerable labor time for installation. Moreover, the joists can be damaged on the top and corners thereof making them uneven. As a result, the present hidden fastener 10 can be installed (even on the damaged joist) because the present hidden fastener 10 and screws engage with vertical sides of the joist.

Figure 9:
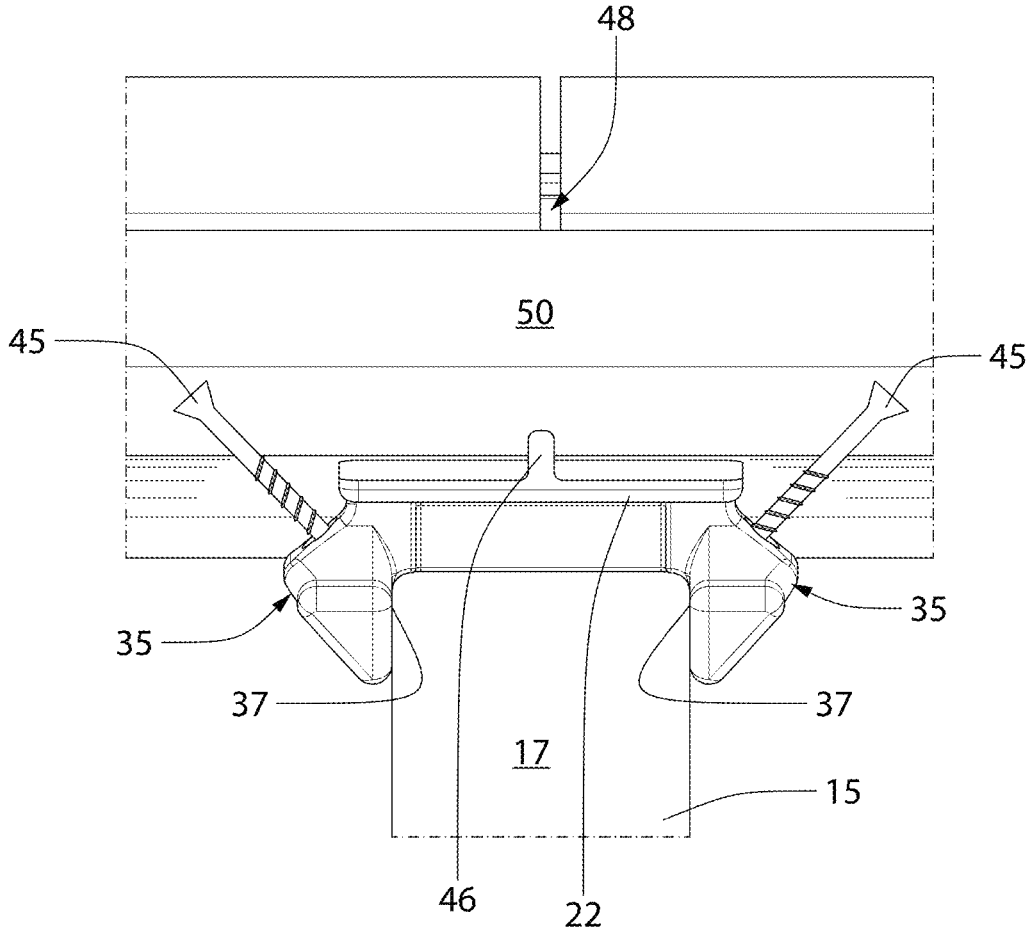

Each leg portion 35 includes an opening 36 in a thick portion 38 thereof for receiving a fastener, e.g., screw 45. As shown in FIG. 9, the screw 45 securely attaches the hidden fastener 10 to the structural member 15 that enters from a topside of the hidden fastener 10 via the opening 36. Advantageously, fastening the screw 45 from the topside requires less effort and provides greater structural connectivity. In addition, there is no need for attaching the screws at two planes, i.e., vertically and horizontally. That is, attaching screws on the top surface and/or the side surfaces of the structural member 15. Moreover, the present hidden fastener 10 prevents and/or reduces the installer from working underneath the decking system, which may cause bodily injuries or harm.

In some implementations, the thick portion 38 of the leg portion 35 can include a countersink for receiving the screw 45 designed for this purpose. For instance, the countersink allows a head of the screw 45 to sit flush with or below the surface of the surrounding material, i.e., thick portion 38.

The openings 36 and screws 45 are oriented at a skewed angle (i.e., inclined) relative to a plane of the top surface 17 of the structural member 15. Accordingly, unlike conventional hidden fasteners, the mounted screws 45 are not oriented perpendicular to the top surface 17 of the structural member 15 and/or perpendicular to a planar surface (i.e., side surface 19) of structural member 15. In some implementations, the angled screw opening 36 is approximately 30-60 degrees, preferably approximately 45 degrees in relation to the structural member 15. Mounting the screw 45 in an angled screw opening 36 results in a better securement to the structural member 15 as each screw 45 extends into a center portion of the structural member 15 at an angle, which creates a tighter securement and/or a greater pull-out resistance. As such, the hidden fastener 10 is less likely to detach from the structural member 15 due to the screws 45 being secured at an angle. The hidden fastener 10, in addition to being less likely to pull out, is also more likely to resist any rotational (mostly downward shear) forces applied from having more load on one side or an uneven installation surface via the shape of the joist. Further, the angled screw 45 tends to draw the hidden fastener 10 sidewardly against the planar side surface 19 of the structural member 15 removing any gaps therebetween for a tight, consistent fit. In addition, the downward driving force of the screw on each side allows the user to modify the inclination of the hidden fastener relative to the incoming boards by tightening or loosening the screws on each side in order to create a more planar transition between the abutting boards.

In other implementations, only a single screw, rather than the two angled side screws may be employed. For example, the hidden fastener in a middle of the top surface 26 can include an opening for receiving the single screw.

Figure 11:
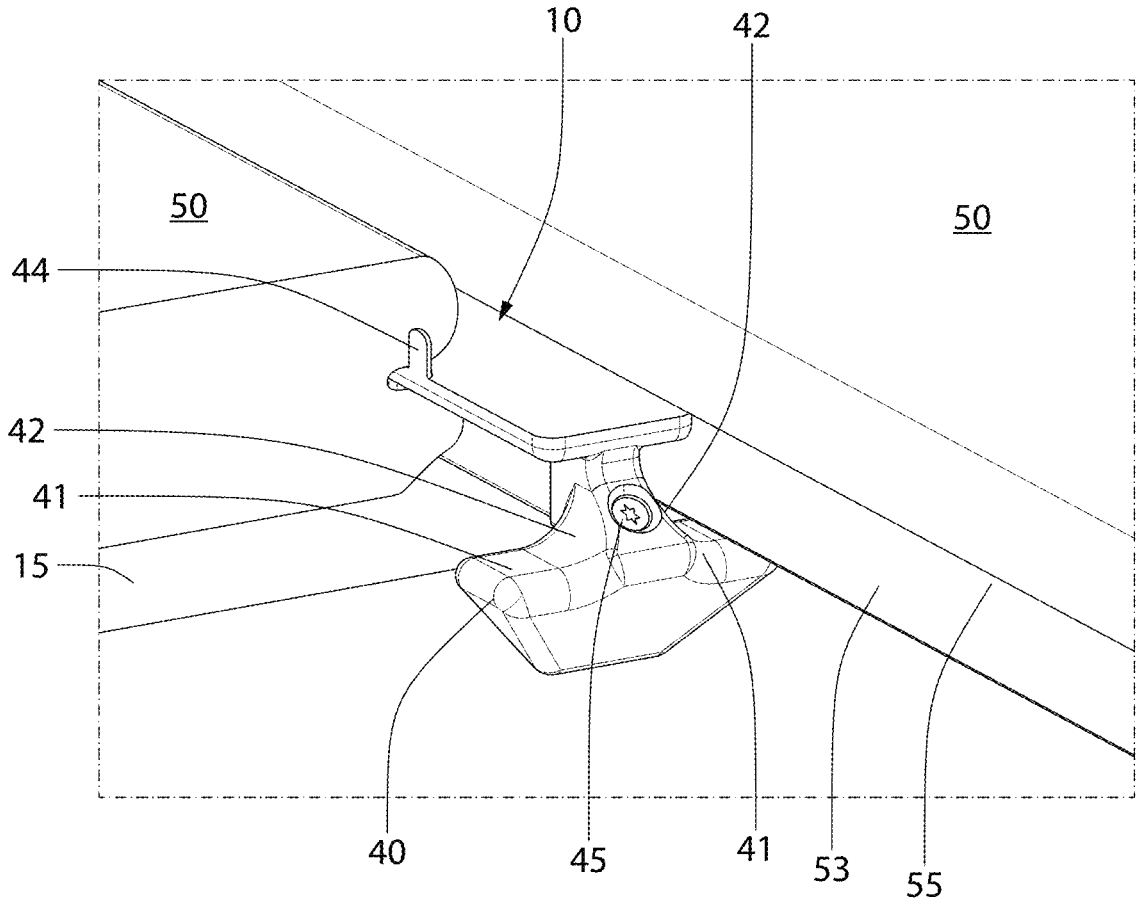

Referring back to FIG. 2, each leg portion 35 further includes a platform 40 that extends at each side of the thick portion 38, forming a generally T-shaped member. The platform 40 includes a flat portion 41 that is configured to engage (support) a bottom surface portion 52 of the board 50, and a curved portion 42 that is configured to cooperatively engage a lower side edge portion 53 of the board 50, as shown in FIG. 11. The curved portion 42 conforms to and has a similar shape as the lower side edge portion 53 of the board 50. The curved portion 42 also acts to constrain the boards 50 from moving once attached to the hidden fastener 10. That is, the curved portion 42 constrains vertical movement and/or any rotational movements of the boards 50. In other implementations, the curved portion 42 does not specifically engage with the board (due to the boards have different radii and profiles). Hence, in this embodiment, the curved portion 42 is to provide strength (stress relief) and support to the leg portion 35 itself. The primary constraint provided by a central vertical portion of the thick portion 38 is constraint of the board's lateral translation and to function as a rigid connection between the extending member 56 and the flat portion 41 of the leg portion 35. Thus, in conjunction with the board 50 being supported on the flat portion 41 and the curved portion 42 and a portion of the constraining member 20 (i.e., extending member 56) slideably engaging into the groove 55, the boards 50 are securely held by the hidden fastener 10.

Figure 5A:
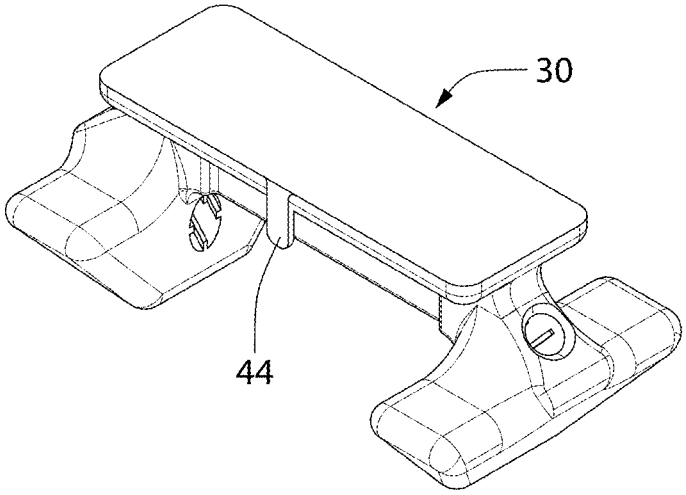
FIGS. 5A and 5B are perspective views of a hidden fastener with different tab members configuration, according to an example embodiment of the present disclosure.
Figure 5B:
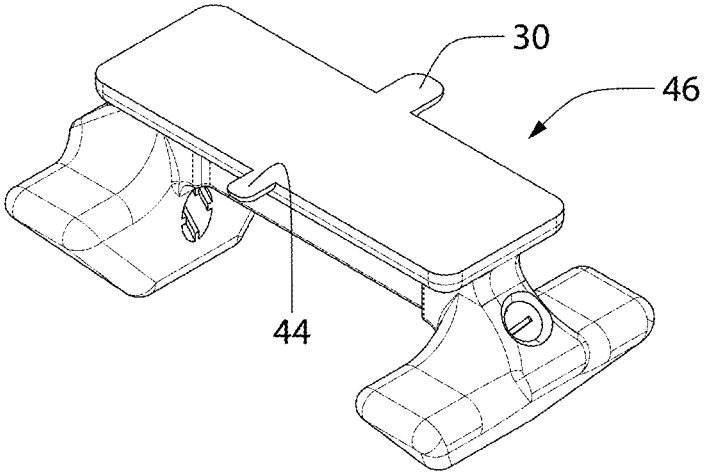
Figure 7:
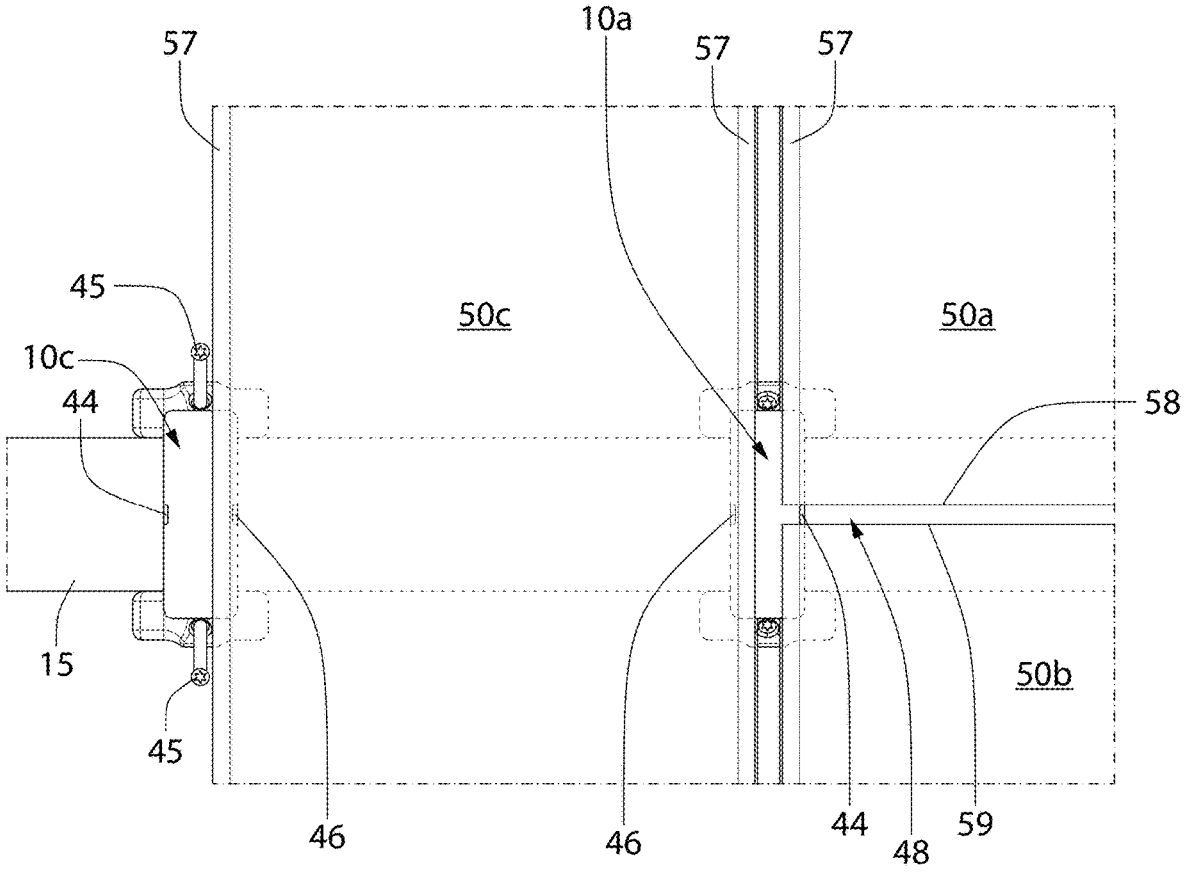

In some implementations, on the top surface 26 of the constraining member 20, a first tab member 44 and a second tab member 46 are formed projecting upwardly therefrom (FIG. 1). Alternatively, the first and second tab members 44, 46 can be formed that project in a downwardly direction (FIG. 5A) or can be formed in a side direction (FIG. 5B) (i.e., extending from a side portion of the top surface 26 in a planar direction). In some implementations, the first and second tab members 44, 46 can be integrally formed approximately at a center portion of sides 22, 21, respectively, of the constraining member 20. In some implementations, the first and second tab members 44, 46 are similar in size and shape. In other implementations, the first and second tab members 44, 46 are different in size and shape. For example, the second tab member 46 is slightly larger than the first tab member 44. In this implementation, due to the different sizes, tab members 44, 46 can act as a reference as to which direction the hidden fastener 10 is attached to the joist 15. By way of example, as shown in FIG. 7, tab member 44 is configured to create spacing (gaps) 48 between ends 58, 59 of boards 50*a*, 50*b*, respectively, that are closely adjacent to each other, and tab member 46 is configured to engage underneath of board 50*c* (i.e., groove (not shown)) which extends across the joist 15 at a non-abutting joint for securement. In other words, the hidden fasteners 10 are arranged in opposite configuration on joist 15 depending on whether a butt joint is needed. In some implementations, the spacing 48 created by the tab member 44 can range between 1/16 inch and 1/4 inch. Additionally, the tab members 44, 46 are different sizes because of the alternative spacing needed between abutting boards based on the environmental temperature, i.e., due to the change in length/spacing caused by a difference between the coefficient of thermal expansion (CTE) of the decking material and the sub-structure. In the embodiment shown, the correct tab (for a given temperature range) is kept in place to provide the desired spacing and the incorrect one may be easily removed (i.e., broken off).

In some implementations, only one tab member (44 or 46) is needed in any single abutment to provide the correct spacing for the boards. Therefore, in any situation where multiple abutments appear adjacent to one another on the same joist, the tab members 44, 46 on the hidden fastener 10 only need to provide spacing to one board by maintaining the orientation of the hidden fastener 10 relative to each other, such that the correct tab 44 or 46 for a given temperature range engages with only a single side of a board; meaning that a user can have access to proper (CTE) gapping via the tab members 44, 46, no matter the number of adjacent abutments.

In some implementations, the first tab member 44 and/or the second tab member 46 can be integrally formed with and has the same material as the constraining member 20, or in the alternative, the first tab member 44 and/or the second tab member 46 can be formed with a different material as the constraining member 20. For example, the first tab member 44 and/or the second tab member 46 can be made from plastic materials or polymers having the same material as the constraining member 20. In other implementations, where the tab members 44, 46 are constructed from a different material, the tab members 44, 46 can be made from metal, for example.

In some implementations, the first and second tab members 44, 46 are generally rectangular shaped. In some implementations, the first and second tab members 44, 46 include a curved top portion so as to reduce damage to the boards. It should be appreciated that the tab members 44, 46 can be designed with other shapes as long as the functionality/purpose of tab members 44, 46 is achieved.

Figure 5C:
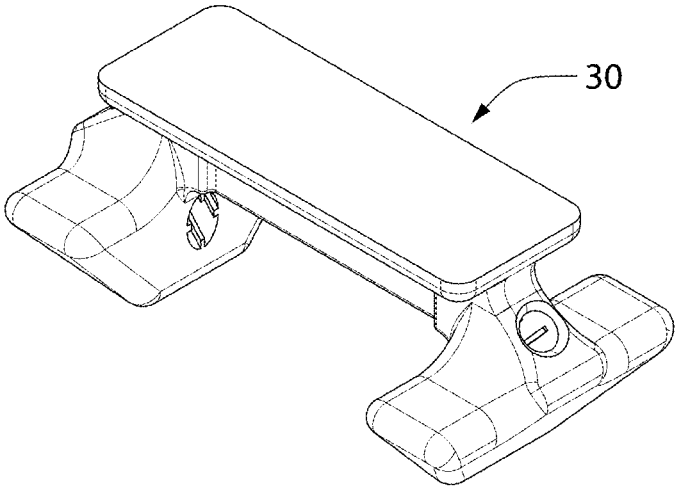
FIG. 5C is a perspective view of a hidden fastener without any tab members, according to an example embodiment of the present disclosure.

While the use of the tab members 44, 46 allow for spacing 48 between the boards 50, it should be appreciated that the disclosed hidden fastener 10 may be designed without the tab members 44, 46, as shown in FIG. 5C, removing any spacing effect created by the tab members 44, 46 and permit the ends of the boards 50 to directly contact each other or for the spacing to be accomplished by manual positioning of the boards 50 with respect to one another.

Figure 8:
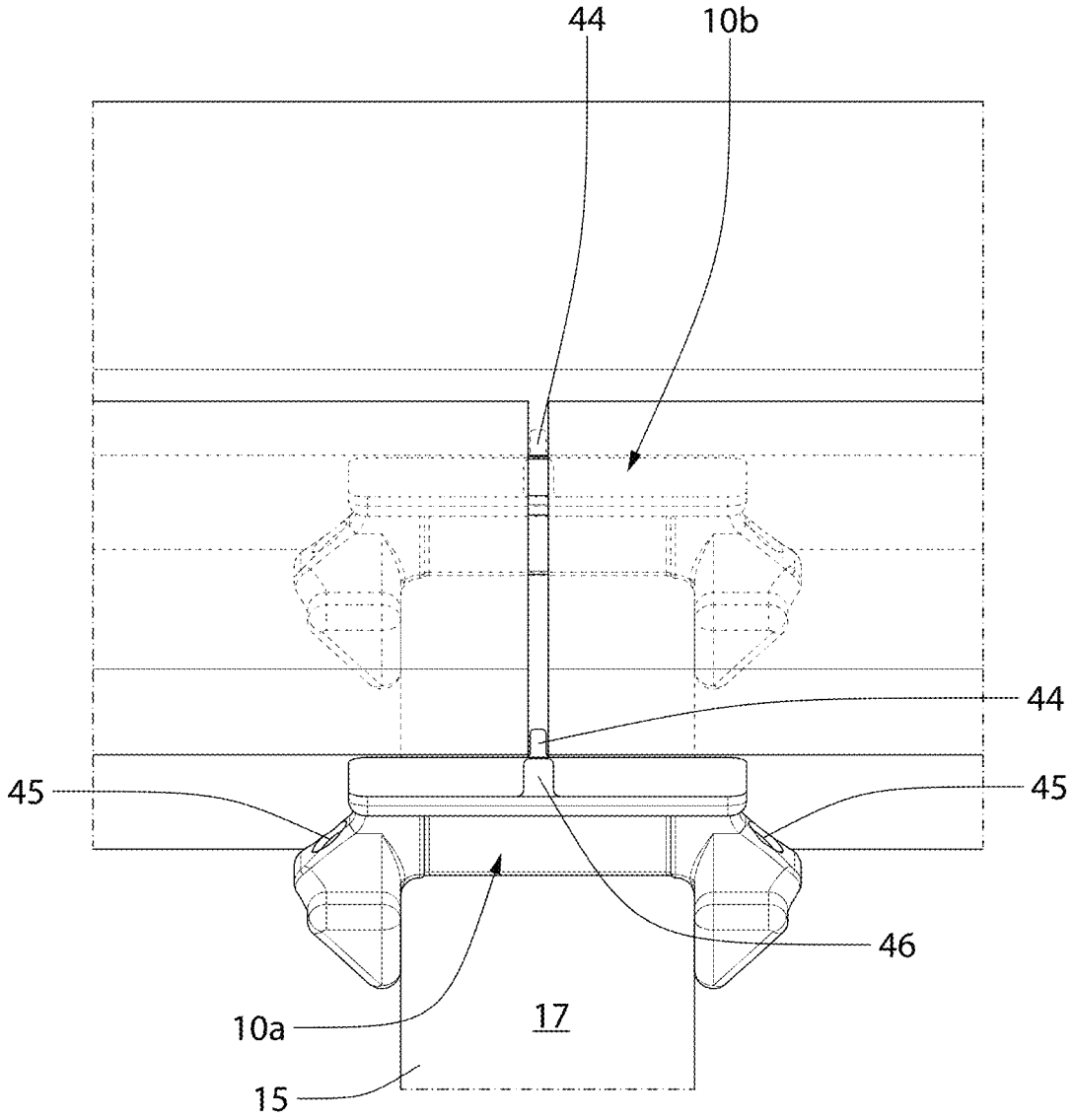

In the example embodiments disclosed in FIGS. 6 and 8, a decking system 1 includes a pair of hidden fasteners (i.e., a first hidden fastener 10*a* and a second hidden fastener 10*b*) that are configured to engage each side 57 of the decking board 50. As such, there are two hidden fasteners 10*a*, 10*b* for each butt joint formed in the decking system 1. As described herein, side 57 depicts a side edge of the board 50 extending in a longitudinal direction.

The first hidden fastener 10*a* is positioned on the joist 15 where the opening 39 formed by the pair of leg portions 35 cooperatively engages with the joist 15. In other words, the pair of legs portions 35 is typically positioned to cooperatively engage with a width dimension of the top surface 17 of the joist 15 when installed. Once positioned, the first hidden fastener 10*a* is installed against the joist 15 by fastening screws 45 at each side at an angle. As discussed earlier, the first hidden fastener 10*a* includes the angled screw openings 36 to enable the screws 45 to penetrate the joist 15 at both sides at approximately 45 degrees, for example. Next, the end portions 58, 59 of respective boards 50*a*, 50*b* are positioned on the first hidden fastener 10*a*, in particular, on the top surface 26 thereof, to form the butt joint on the joist 15. The groove 55 of each board 50*a*, 50*b* at the edge sides 57 thereof engages the constraining member 20 of the hidden fastener 10*a* to properly align and hold the boards 50*a*, 50*b* to the hidden fastener 10*a*. Using the tab member 44 formed on the top surface 26 of the hidden fastener 10*a*, spacing 48 is formed between end 58 of board 10*a* and end 59 of board 10*b*. To complete the installation, the second hidden fastener 10*b* is installed on the other side edge 57 of boards 50*a*, 50*b* (opposite the first hidden fastener 10*a*). The second hidden fastener 10*b* similarly slideably engages with the top surface 17 of the joist 15 until the constraining member 20 of the second hidden fastener 10*b* engages the groove 55 formed on the other edge side 57 of the boards 50*a*, 50*b*. At this stage, both tab members 44 on the respective first and second hidden fasteners 10*a*, 10*b* are aligned with the respective edge sides 57, i.e., facing each other. The tab member 44 on the second hidden fastener 10*b* ensures a consistent spacing 48 is formed with respect to the first hidden fastener 10*a*. Once in position, screws 45 penetrate the joist 15 on each side of the second hidden fastener 10*b* to completely secure the two ends of the boards, forming the butt joint.

Figure 10:
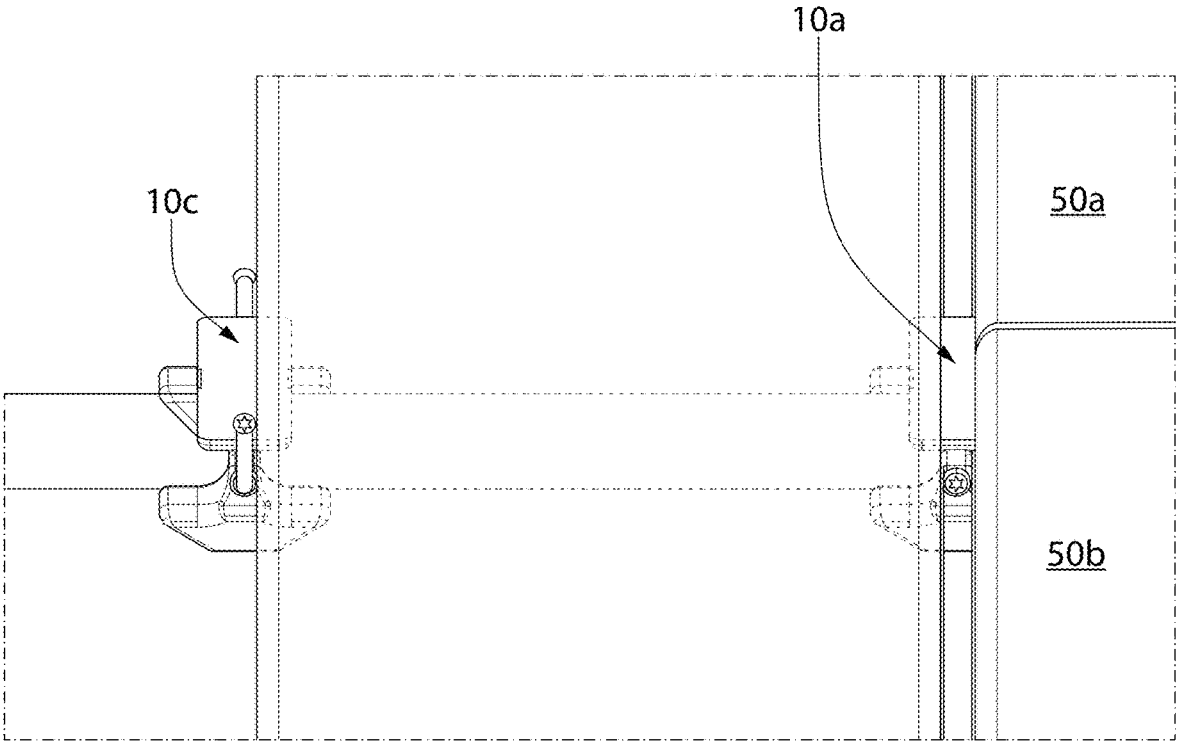

As shown in FIGS. 7 and 10, a third hidden fastener 10*c* is installed on the joist 15; however, the third hidden fastener 10*c* is installed in an opposite configuration in relation to the first or second hidden fasteners 10*a*, 10*b*, in that the second tab member 46 engages the board 50*c*. In other words, at each side 57 of board 50*c*, the second tab member 46 of the respective hidden fasteners engages underneath the board 50*c* via a groove (not shown). Because board 50*c* lays across the joist 15 at a middle portion thereof, there exists no butt joints over this particular portion of the joist 15. In one implementation, hidden fastener 10*c* would only be installed in this configuration if there were an abutment to the left hidden fastener 10*c* in FIG. 10; otherwise a more typical fastener could be used. In this implementation, regarding the tab member 44, it would be removed (broken off) from hidden fastener 10*a* in order to properly engage with board 50*c*.

In some implementations, the butt joints are alternating between every other decking board in a longitudinal pattern. That is, butt joints are formed over a single joist in alternating manner.

In some implementations, the present hidden fastener provides the board improved support due to the support platforms that are under each board adjacent to the joist and allows for some limited adjustment of individual board heights due to the dual screw design.

The hidden fastener in any embodiment can be manufactured from any number of materials having suitable strength characteristics. For example, the hidden fastener can be constructed from plastic materials or polymers, such as, but not limited to, polyethylene terephthalate (PET), high density polyethylene (HDPE), low density polyethylene (LDPE), polypropylene (PP), and/or polyvinyl chloride (PVC). Due to the inherent and mechanical properties of plastic (e.g., density, toughness, low electrical conductivity, transparency, etc.), the hidden fastener can be light weight and durable to withstand external force (e.g., impact, drops, stress, and the like). By way of example, the hidden fastener is manufactured from molded polycarbonate. This material provides strong members that are corrosion and/or mold resistant and which can be clear, tinted, colored, translucent or opaque as desired and therefore desirably less visible than metal or colored components in a finished deck system. The hidden fastener 10 can be formed of any colors, such as, black, grey, brown, white, etc., in addition, to matching the color of the boards 50. In one example embodiment, the hidden fastener is made from glass-filled Nylon.

The decking boards are disclosed as composite boards or wooden deck boards. However, the decking boards are also available in many materials including hardwoods, plastics and composites formed from a combination of materials.

As described herein, the term "proximal" end relates to an end being closest to the user, and the term "distal" end relates to an end being farthest from the user.

The articles "a" and "an," as used herein, mean one or more when applied to any feature in embodiments of the present disclosure described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used. The adjective "any" means one, some, or all indiscriminately of whatever quantity.

"At least one," as used herein, means one or more and thus includes individual components as well as mixtures/combinations.

The transitional terms "comprising", "consisting essentially of" and "consisting of", when used in the appended claims, in original and amended form, define the claim scope with respect to what unrecited additional claim elements or steps, if any, are excluded from the scope of the claim(s). The term "comprising" is intended to be inclusive or open-ended and does not exclude any additional, unrecited element, method, step or material. The term "consisting of" excludes any element, step or material other than those specified in the claim and, in the latter instance, impurities ordinarily associated with the specified material(s). The term "consisting essentially of" limits the scope of a claim to the specified elements, steps or material(s) and those that do not materially affect the basic and novel characteristic(s) of the claimed disclosure. All materials and methods described herein that embody the present disclosure can, in alternate embodiments, be more specifically defined by any of the transitional terms "comprising," "consisting essentially of," and "consisting of."

Although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that, if an element is referred to as being "connected" or "coupled" to another element, it can be directly connected, or coupled, to the other element or intervening elements may be present. In contrast, if an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

Spatially relative terms (e.g., "beneath," "below," "lower," "above," "upper" and the like) may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation that is above, as well as, below. The device may be otherwise oriented (rotated 90 degrees or viewed or referenced at other orientations) and the spatially relative descriptors used herein should be interpreted accordingly.

Example embodiments are described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments should not be construed as limited to the particular shapes of regions illustrated herein but may include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed:

1. A hidden fastener, comprising:

a constraining member configured to support a plurality of boards, the constraining member being elongated along a longitudinal axis and comprising a top surface, a first side edge located on a first side of the longitudinal axis and a first tab member extending from the first side edge of the constraining member, and a second side edge located on a second side of the longitudinal axis and a second tab member extending from the second side edge of the constraining member, the constraining member having a first width measured between the first and second side edges in a direction perpendicular to the longitudinal axis, and wherein the top surface of the constraining member is configured to support a portion of at least one of the plurality of boards;

a base member extending below the constraining member, the base member including a base portion and a pair of leg portions that includes a first leg portion located at a first end of the base member and a second leg portion located at a second end of the base member, each of the first and second leg portions comprising an opening extending at an inclined angle relative to the longitudinal axis for receiving a fastener at an inclined position;

wherein the pair of leg portions is configured to be attached to a structural member via a spacing formed between the pair of leg portions, the spacing corresponding to a size of a top surface of the structural member; and wherein the first and second leg portions each have a second width measured in the direction perpendicular to the longitudinal axis of the constraining member, the second width being greater than the first width such that each of the first and second leg portions extends beyond the first and second side edges of the constraining member in the direction perpendicular to the longitudinal axis.

2. The hidden fastener of claim 1, wherein one of:

the first and second tab members extend outwardly from the first and second side edges of the constraining member, respectively, in a direction away from the longitudinal axis;

the first and second tab members extend perpendicularly from the first and second side edges of the constraining member, respectively, in a direction away from to the first and second leg portions of the base member; or the first and second tab members extend perpendicularly from the first and second side edges of the constraining member, respectively, in a direction towards the first and second leg portions of the base member.

3. The hidden fastener of claim 1, wherein the first tab member has a first tab width measured along the first side edge of the constraining member and the second tab member has a second tab width measured along the second side edge of the constraining member, the second tab width being different than the first tab width.

4. The hidden fastener of claim 1, wherein the first tab member has a first tab width measured along the first side edge of the constraining member and the second tab member has a second tab width measured along the second side edge of the constraining member, the first and second tab widths being the same.

5. The hidden fastener of claim 1, wherein the first leg portion has a first central body portion that extends outwardly from a first end portion of the base portion and the second leg portion has a second central body portion that extends outwardly from a second end portion of the base portion, each of the first and second central body portions comprising an outer surface that is oriented at an oblique angle relative to the longitudinal axis and an inner surface that is oriented at a perpendicular angle relative to the longitudinal axis.

6. The hidden fastener of claim 5, wherein the first leg portion comprises first and second platform portions that extend in opposite directions from opposing sides of the first central body portion and the second leg portion comprises third and fourth platform portions that extend in opposite directions from opposing sides of the second central body portion, wherein at least a portion of the first and third platform portions protrude beyond the first side edge of the constraining member, and wherein at least a portion of the second and fourth platform portions protrude beyond the second side edge of the constraining member.

7. The hidden fastener of claim 1, wherein each of the first and second leg portions has a central body portion and a pair of platform portions that extend from opposite sides of the central body portion, wherein the pair of platform portions of each of the first and second leg portions comprises an upper surface comprising a curved portion that extends from the central body portion and a flat portion that extends from the curved portion, the flat portion of the upper surface of each of the pair of platform portions of each of the first and second leg portions lying in a plane that is parallel to the top surface of the constraining member, wherein each curved portion is configured to receive and engage with a side portion of at least one of the plurality of boards while each flat portion is configured to engage with a bottom portion of the at least one of the plurality of boards.

8. The hidden fastener of claim 1, wherein the base member comprises a first side surface and a second side surface opposite the first side surface, the constraining member comprising a first side extending member that extends beyond the first side surface of the base member and a second side extending member that extends beyond the second side surface of the base member, the first and second side extending members configured to engage with a groove formed in a side portion of at least one of the plurality of boards.

9. The hidden fastener of claim 1, wherein any plane perpendicular to the top surface of the constraining member and parallel to the longitudinal axis of the constraining member intersects that constraining member and each of the first and second leg portions.

10. A hidden fastener, comprising:

a constraining member configured to support a plurality of boards, the constraining member comprising a top surface, a first end, a second end, and a longitudinal axis that extends from the first end to the second end;

a base member extending below the constraining member, the base member including a base portion, a first leg portion, and a second leg portion, the first leg portion comprising a first angled screw hole and the second leg portion comprising a second angled screw hole, the first and second angled screw holes configured to receive a fastener at an inclined position;

wherein the first and second leg portions are configured to attach to a structural member via a spacing formed between the first and second leg portions, the spacing corresponding to a size of a top surface of the structural member;

wherein each of the first and second leg portions comprises a platform that is configured to support a bottom surface of one of the plurality of boards, and wherein a first portion of the platform of each of the first and second leg portions extends beyond one of the first and second ends of the constraining member in a direction of the longitudinal axis; and wherein any plane perpendicular to the top surface of the constraining member and parallel to the longitudinal axis intersects the constraining member and each of the first and second leg portions.

11. The hidden fastener according to claim 10 further comprising:

the constraining member comprising a first side edge and a second side edge that extend parallel to the longitudinal axis;

wherein a first plane that is perpendicular to the longitudinal axis intersects the first and second edges of the constraining member and a second portion of the platform of the first leg portion;

wherein a second plane that is parallel to the first plane intersects the first portion of the platform of the first leg portion without intersecting the constraining member;

wherein a third plane that is parallel to the first plane intersects the first and second edges of the constraining member and a second portion of the platform of the second leg portion; and wherein a fourth plane that is parallel to the first plane intersects the first portion of the platform of the second leg portion without intersecting the constraining member.

12. The hidden fastener according to claim 10 wherein the top surface of the constraining member is a planar surface that extends continuously and uninterruptedly from the first end of the constraining member to the second end of the constraining member.

13. The hidden fastener according to claim 10 further comprising:

wherein the first leg portion is located at a first end of the base member and the second leg portion is located at a second end of the base member, each of the first and second leg portions comprising the platform and a central body portion having an outer surface, the platform comprising first and second platform portions that extend from opposite sides of the central body portion, each of the first and second platform portions having a flat top surface;

the first angled screw hole extending through the central body portion of the first leg portion at a location between the first and second platform portions of the first leg portion, the first angled screw hole terminating at a first opening in the outer surface of the central body portion of the first leg portion, the first opening being at an elevation between the flat top surface of the first and second platform portions of the first leg portion and the constraining member; and the second angled screw hole extending through the central body portion of the second leg portion at a location between the first and second platform portions of the second leg portion, the second angled screw hole terminating at a second opening in the outer surface of the central body portion of the second leg portion, the second opening being at an elevation between the flat top surface of the first and second platform portions of the second leg portion and the constraining member.

14. A method of installing a hidden fastener to a butt end of a board, comprising:

attaching a first hidden fastener to a structural member, the first hidden fastener including a pair of leg portions that correspondingly engage with a top side surfaces of the structural member, a constraining member, and a first tab;

engaging a first side of a first board with a first side edge of the constraining member of the first hidden fastener so that a first end of the first board engages a first side of the first tab that is integral with and extends from the first side edge of the constraining member of the first hidden fastener;

engaging a first side of a second board with the first hidden fastener so that a second end of the second board engages a second side of the first tab of the first hidden fastener, the second end of the second board facing the first end of the first board and being spaced apart from the first end of the first board by the first tab;

attaching a second hidden fastener to the structural member opposite to the first hidden fastener so that a second side of the first board engages the second hidden fastener and a second side of the second board engages the second hidden fastener.

15. The method of claim 14, wherein attaching the first hidden fastener to the structural member includes extending a fastener through an angled opening in each of the pair of leg portions and into the structural member.

16. The method of claim 14, wherein the second hidden fastener comprises a second tab, the first end of the first board engaging a first side of the second tab and the second end of the second board engaging a second side of the second tab.

17. The method of claim 14, wherein engaging the first side of the first board with the first hidden fastener includes inserting a side portion of the first hidden fastener into a groove formed at the first side of the first board.

18. The method of claim 14, wherein engaging the first side of the second board with the first hidden fastener includes inserting a side portion of the first hidden fastener into a groove formed at the first side of the second board.

19. The method of claim 14, wherein engaging the second side of the first board with the second hidden fastener includes inserting a side portion of the second hidden fastener into a groove formed at the second side of the first board.

20. The method of claim 14, wherein engaging the second side of the second board with the second hidden fastener includes inserting a side portion of the second hidden fastener into a groove formed at the second side of the second board.

* * * * *